US008496398B2

(12) United States Patent
DiPietro

(10) Patent No.: US 8,496,398 B2
(45) Date of Patent: Jul. 30, 2013

(54) REBAR SLEEVE UNIT

(75) Inventor: Michael DiPietro, Highland Park, IL (US)

(73) Assignee: Michael DiPietro, Highland Park, IL (US)

( * ) Notice: Subject to any disclaimer, the term of this patent is extended or adjusted under 35 U.S.C. 154(b) by 74 days.

(21) Appl. No.: 12/849,859

(22) Filed: Aug. 4, 2010

(65) Prior Publication Data

US 2011/0302880 A1 Dec. 15, 2011

Related U.S. Application Data

(60) Provisional application No. 61/354,413, filed on Jun. 14, 2010.

(51) Int. Cl.
*E01C 11/14* (2006.01)

(52) U.S. Cl.
USPC ..... 404/60; 404/62; 404/52; 404/134; 52/396.02

(58) Field of Classification Search
USPC ..... 404/48, 51, 52, 56, 60, 62, 63, 135, 404/136; 52/396.02–396.07, 677
See application file for complete search history.

(56) References Cited

U.S. PATENT DOCUMENTS

| | | | | |
|---|---|---|---|---|
| 2,186,104 | A * | 1/1940 | Taubensee et al. | 404/60 |
| 2,323,026 | A * | 6/1943 | Geyer | 404/48 |
| 2,608,142 | A * | 8/1952 | Jacobson | 404/60 |
| 2,674,164 | A * | 4/1954 | Brickman | 404/63 |
| 5,005,331 | A | 4/1991 | Shaw | |
| 5,216,862 | A | 6/1993 | Shaw | |
| 5,383,740 | A | 1/1995 | Lancelot, III | |
| 6,449,919 | B1 | 9/2002 | Behlen | |
| 6,922,968 | B1 | 8/2005 | Behlen | |
| 7,467,777 | B2 | 12/2008 | Huber | |

* cited by examiner

*Primary Examiner* — Matthew D Troutman
(74) *Attorney, Agent, or Firm* — Alex R. Hobson; Invention To Patent Services LLC

(57) ABSTRACT

A rebar sleeve device comprising a tubular unit with an opening at least one end thereof for receipt of a rebar dowel is described. The tubular unit is typically positioned horizontally and can be elevated by a back extension component and a front extension component secured to the base unit. The front extension component comprises an opening through which the rebar dowel is inserted. The opening of the front extension component comprises a protective covering. The protective covering prevents concrete from filling in the opening, but allows for the insertion of a rebar dowel. A connection component connects a plurality of the rebar sleeve devices together to form a single unit.

16 Claims, 7 Drawing Sheets

REBAR SLEEVE UNIT

CROSS-REFERENCE

This application claims priority from Provisional Patent Application Ser. No. 61/354,413 filed Jun. 14, 2010.

BACKGROUND

The current process for laying slabs of concrete can be time-consuming, expensive, and labor-intensive. Laborers must pour concrete into their designated beds, wait for the concrete to set, and then manually create spaces in the concrete through which rebar dowels can be installed. To do this, workers may use large power tools to drill a series of holes into the concrete slab, and then install each rebar dowel. The entire process must be repeated approximately twelve inches on center with each concrete slab that is created. While such use of power tools is effective, it is also time-consuming, and often results in inconsistent quality.

Consequently, a need exists for construction workers to quickly and easily install rebar components into freshly-applied, concrete. A simpler, more consistent and time-efficient solution is necessary that would provide construction workers with an efficient tool for connecting slabs of concrete, such as for a roadway. The proposed invention allows for a series of evenly-spaced rebar sleeve devices that are installed before concrete is poured into its corresponding concrete bed. The concrete forms around the rebar sleeve device and sets, creating a series of deep holes into which rebar dowels are inserted. Construction workers may then use this product to connect concrete slabs for roadway construction or other similar projects.

SUMMARY

The following presents a simplified summary in order to provide a bask understanding of some aspects of the disclosed innovation. This seminary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof comprises a rebar sleeve device. The rebar sleeve device comprises a fibular unit with an opening at least one end thereof for receipt of a rebar dowel. The tubular unit is typically positioned horizontally and can be elevated by a back extension component and a front extension component secured to the base unit. The front extension component comprises an opening through which the rebar dowel is inserted. The opening of the front extension component comprises a protective covering. The protective covering prevents concrete from filling in the opening, but allows for the insertion of a rebar dowel.

Furthermore in the preferred embodiment of the present invention, a connection component is applied to the rebar sleeve device. The connection component is typically used to connect eight rebar sleeve devices together. However, virtually any number of rebar sleeve devices can be used or connected without affecting the overall scope of the invention. This allows for a series of evenly-spaced rebar sleeve devices to be installed before concrete is poured into its corresponding concrete bed.

Further, a form is applied to cover the front extension component of the rebar sleeve devices. Concrete is then poured into the concrete bed and left to set. Once the concrete is set, the form is removed to expose holes in the concrete created by the rebar sleeve devices. Rebar dowels are then inserted into each hole.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and, novel features will become apparent from the following detailed description when considered in conjunction with the drawings.

DETAILED DESCRIPTION

Figure 1:
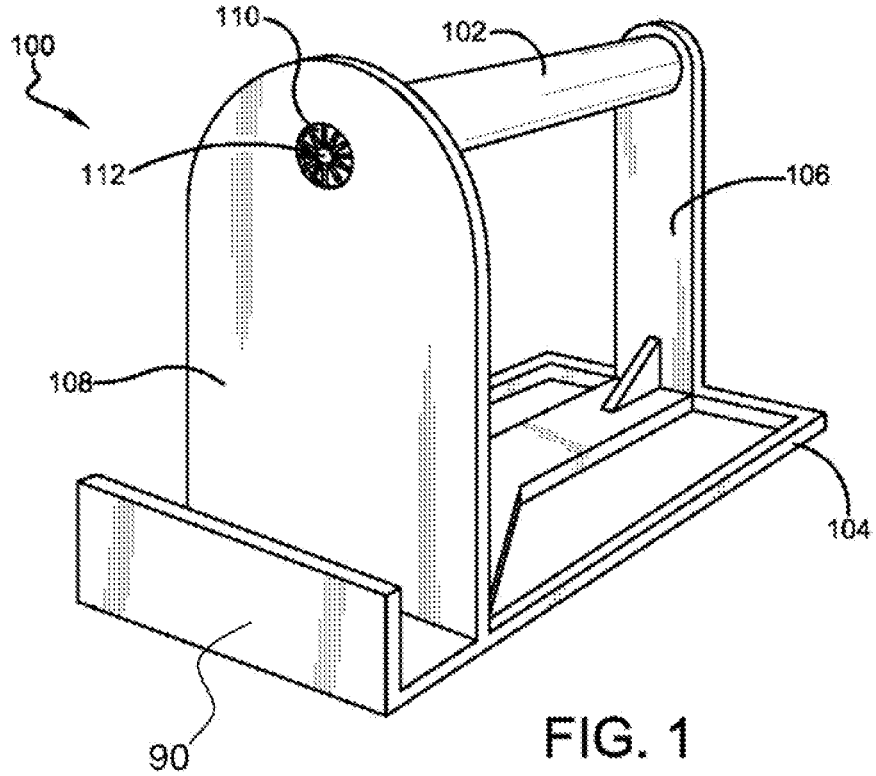
FIG. 1 illustrates a perspective view of a rebar sleeve device.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Typically, laying slabs of concrete can be time-consuming, expensive, and labor-intensive. Laborers must pour concrete into their designated beds, wait for the concrete to set, and then manually create spaces in the concrete through which rebar dowels can be installed. A rebar sleeve device would allow construction workers to quickly and easily install rebar components into concrete.

Accordingly, the disclosed rebar sleeve system allows for a series of evenly-spaced rebar sleeve devices that are installed before concrete is poured into its corresponding concrete bed. The concrete forms around the rebar sleeve devices and sets, creating a series of holes into which rebar dowels are inserted. Construction workers may use this product to connect concrete slabs for roadway construction or other similar projects.

Referring initially to the drawings, FIG. 1 illustrates a rebar sleeve device 100. The rebar sleeve device 100 comprises a tubular unit 102 with an opening at least one end thereof for receipt of a rebar dowel (not shown). A base unit 104 supports the tubular unit 102 and is configured for placement directly on the ground in a concrete bed, as herein described. The tubular unit 102 is typically positioned horizontally and can be elevated by a back extension component 106 and a front extension component 108 secured to the base unit 104. The rebar sleeve device as shown in FIG. 1 is self-supporting, in that the tubular unit is supported by front extension component 108 and back extension component 106 secured to the base unit 104, and the base unit is placed on the ground in a concrete bed. In an exemplary embodiment, as shown in FIG. 1, the rebar sleeve device is comprised of au integral tubular unit 102, integral front extension component 106 and integral base unit 104. Integral, as used herein, means that components including, but not limited to, a tubular unit 102, front extension component 106, back extension component 106, and base unit 104 are part of the rebar sleeve device 100, and not an external component, such as concrete form, wire, rod or other structural support. In an exemplary embodiment, a rebar sleeve device is comprised of an integral tubular unit 102, elevated by an integral front extension component 106, and integral back extension component, secured to a base unit 104, whereby the tubular unit 102 extends between the front extension component and the back extension component, as shown in FIG. 1. In one embodiment, the integral tubular unit 102, integral front extension component 106 and integral base unit 104 are all contiguously attached, therein not detachable attached. The front extension component 108 is typically a slab with a rounded top, but does not have to be, and can be any suitable shape. The front extension component 108 also comprises a flange 90 that curves up to secure the rebar sleeve device 100 with existing concrete forms (not shown). The flange as shown in FIG. 1 extends up from the bottom of the front extension component and is attached to the front extension component. However, any amount of material and/or shape or size of the front extension component 108 can be used depending on cost and other building requirements without detracting from the claimed invention.

Furthermore, the front extension component 108 comprises an opening 110 through which the rebar dowel is inserted. The opening 110 is typically a generally, circular hole, however, it can be any suitable shape to accept a rebar dowel. The opening 110 of the front extension component 108 comprises a protective covering 112. The protective covering 112 prevents concrete from filling in the opening 110, but allows for the insertion of a rebar dowel. Specifically, the protective covering 112 is scored and bends inward to accommodate an inserted rebar dowel. The protective covering 112 is typically plastic but can be any suitable material for preventing, concrete from filling in the opening 110, but also allowing the insertion of a rebar dowel.

Furthermore, the tubular unit is comprised of polymer material and/or metal, but can be comprised of any suitable material.

Figure 2:
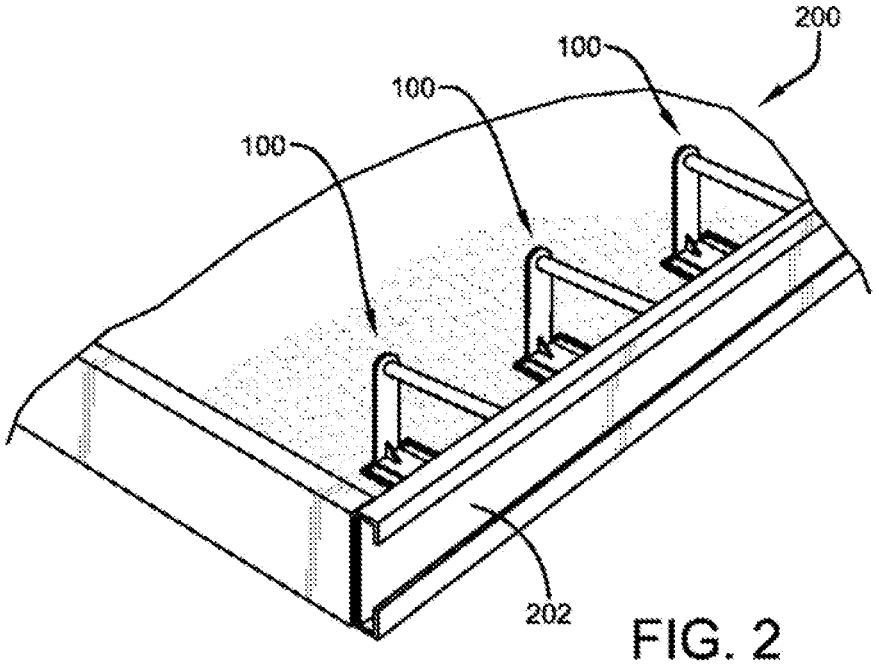
FIG. 2 illustrates a perspective view of the rebar sleeve system wherein a form is applied to the rebar sleeve devices.

In more detail, FIG. 2 illustrates a mbar sleeve system 200 wherein a form 202 is applied to the rebar sleeve devices 100. The form 202 is typically metal or wood and is applied to cover the front extension component of the mbar sleeve devices 100. Typically, the form 202 is ten feet in length, but can be any suitable length needed. In use, the rebar sleeve devices 100 are positioned in a concrete bed and the form 202 is applied to cover the front extension component of each rebar sleeve device 100. Concrete is then poured into the bed and left to set. Once the concrete is set, the form 202 is removed to expose holes in the concrete created by the rebar sleeve devices 100. Rebar dowels are then inserted into each hole.

Figure 3:
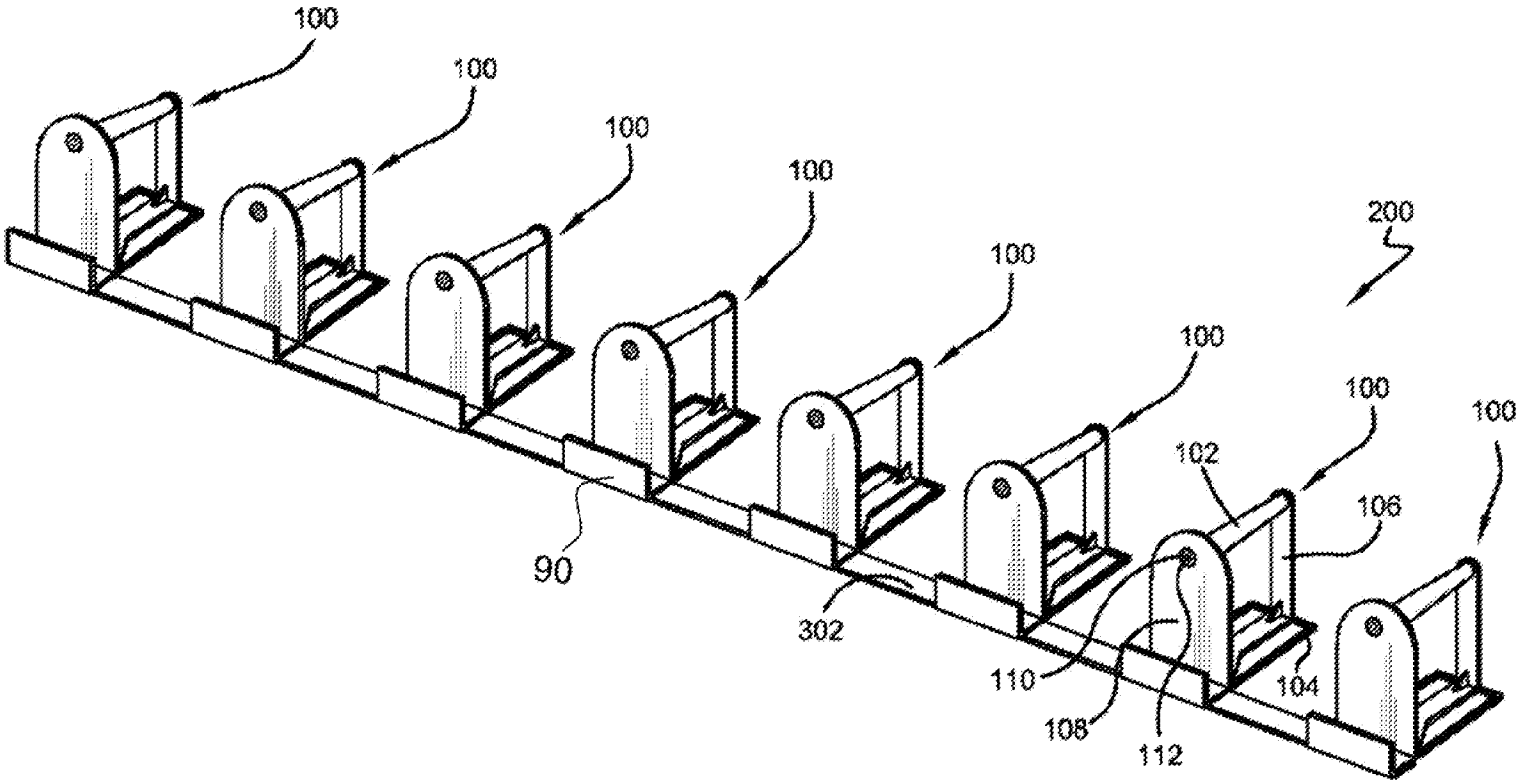
FIG. 3 illustrates a perspective view of the rebar sleeve system wherein eight rebar sleeve devices are connected together via a connection component.

FIG. 3 illustrates the rebar sleeve system 200 wherein eight rebar sleeve devices 100 are connected together via a connection component 302. The connection component 302 secures the rebar sleeve devices 100 together as one unit. The mbar sleeve system 200 can then be placed in a concrete bed. This allows for a series of generally, evenly-spaced rebar sleeve devices 100 to be installed before concrete is poured into its corresponding bed. The connection component 302 is typically plastic, but can be comprised of any suitable material. The connection component 302 is typically thrilled integral with the rebar sleeve devices 100 as a one-piece unit, but can also be manufactured as a separate component and secured to the rebar sleeve devices 100 at a later time.

The rebar sleeve devices 100 comprise a tubular unit 102 with an opening at least one end thereof for receipt of a rebar dowel (not shown). The tubular unit 102 is typically positioned horizontally and can be elevated by a back extension component 106 and a front extension component 108 secured to a base unit 104. The front extension component 108 also comprises an opening 110 through which the rebar dowel is inserted. The opening 110 of the front extension component 108 comprises a protective covering 112. The protective covering 112 prevents concrete from tilling in the opening 110, but allows for the insertion of a rebar dowel. Specifically, the protective covering 112 is scored and bends inward to accommodate an inserted rebar dowel.

Figure 4:
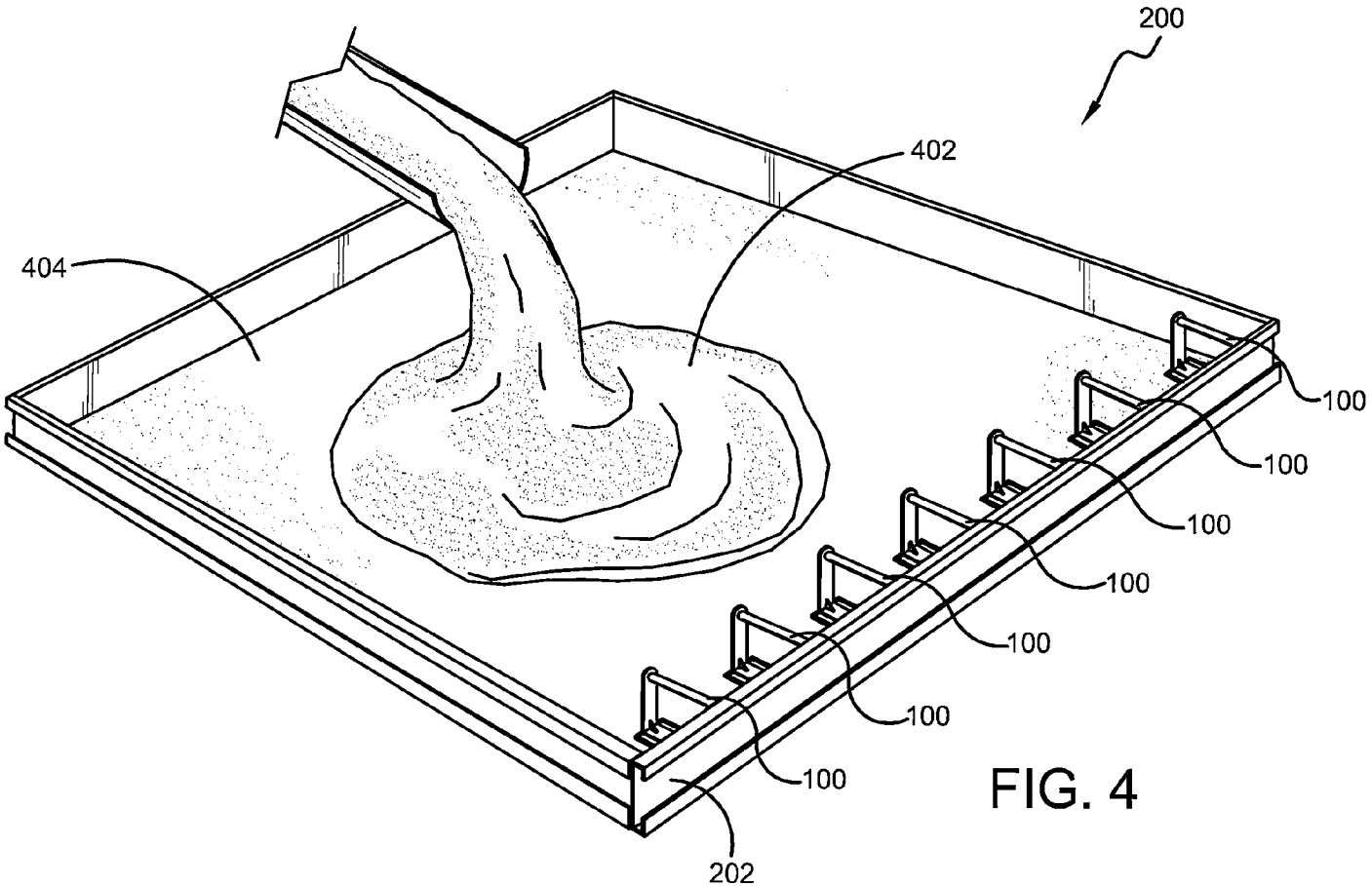
FIG. 4 illustrates a perspective view of the rebar sleeve system wherein concrete is being poured into a bed.
Figure 5:
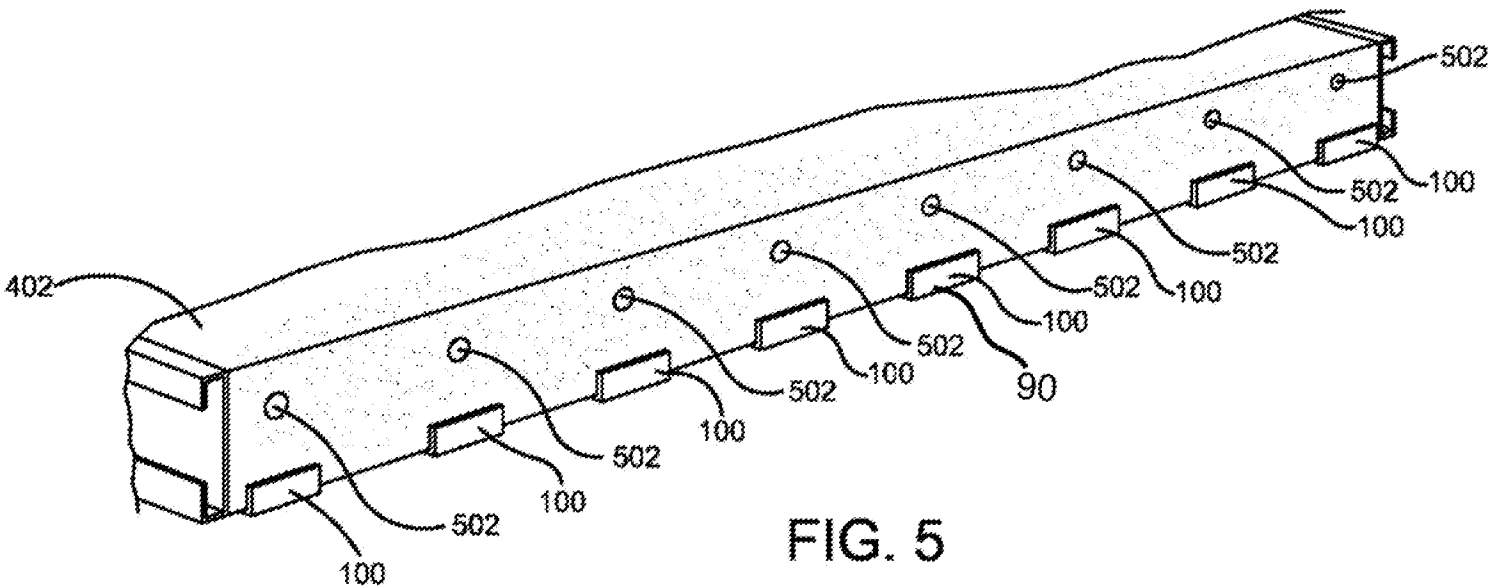
FIG. 5 illustrates a perspective view of the concrete wherein holes have been formed by the rebar sleeve system.
Figure 6:
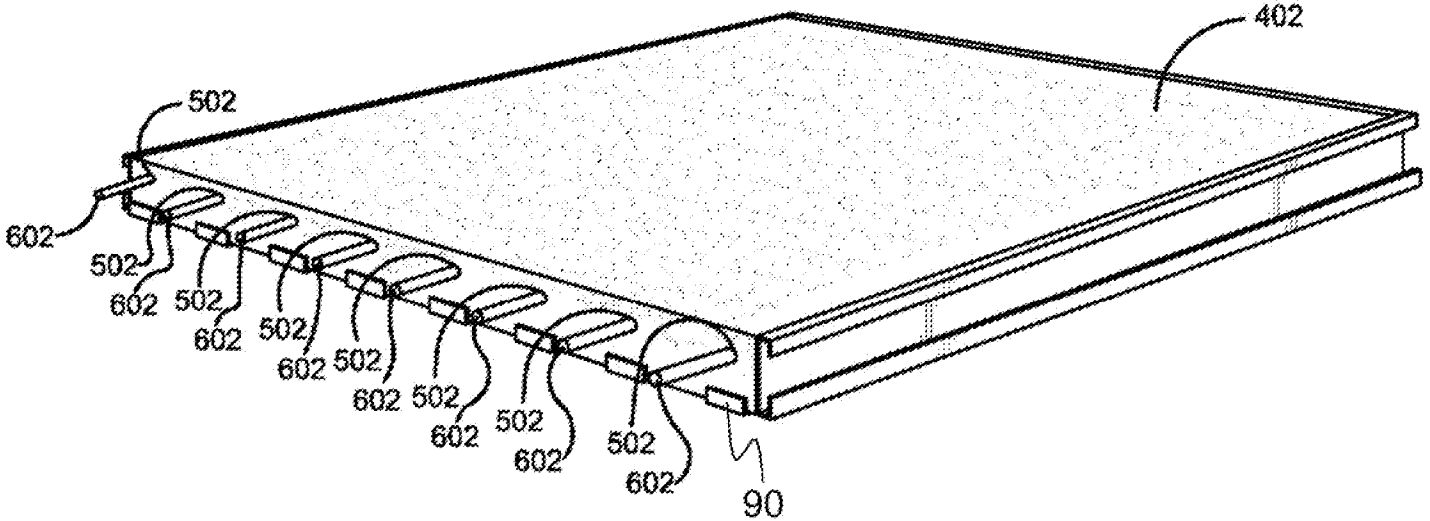
FIG. 6 illustrates a perspective view of the concrete wherein rebar dowels have been inserted into the holes formed by the rebar sleeve system.

Furthermore, FIGS. 4-6 illustrate the rebar sleeve system 200 in use. As shown in FIG. 4, the rebar sleeve devices 100 are secured together via a connection component (not shown) and positioned in a concrete bed 404. This allows for a series of generally, evenly-spaced rebar sleeve devices 100 to be installed before concrete 402 is poured into the concrete bed 404. Form 202 is applied to cover the front extension component of each rebar sleeve device 100. Concrete 402 is then poured into the bed 404 and left to set. As shown in FIG. 5, concrete forms around the rebar sleeve devices 100 creating a series of holes 502. Once the concrete 402 is set, the form is removed to expose the holes 502 in the concrete 402 created by the rebar sleeve devices 100. The flange 90 of the rebar sleeve device is shown in FIG. 5 where the form has been removed. As shown in FIG. 6, rebar dowels 602 are then inserted into each hole 502 of the hardened concrete 402. Construction workers can then use this product to connect concrete slabs for roadway construction or other similar projects.

Figure 7:
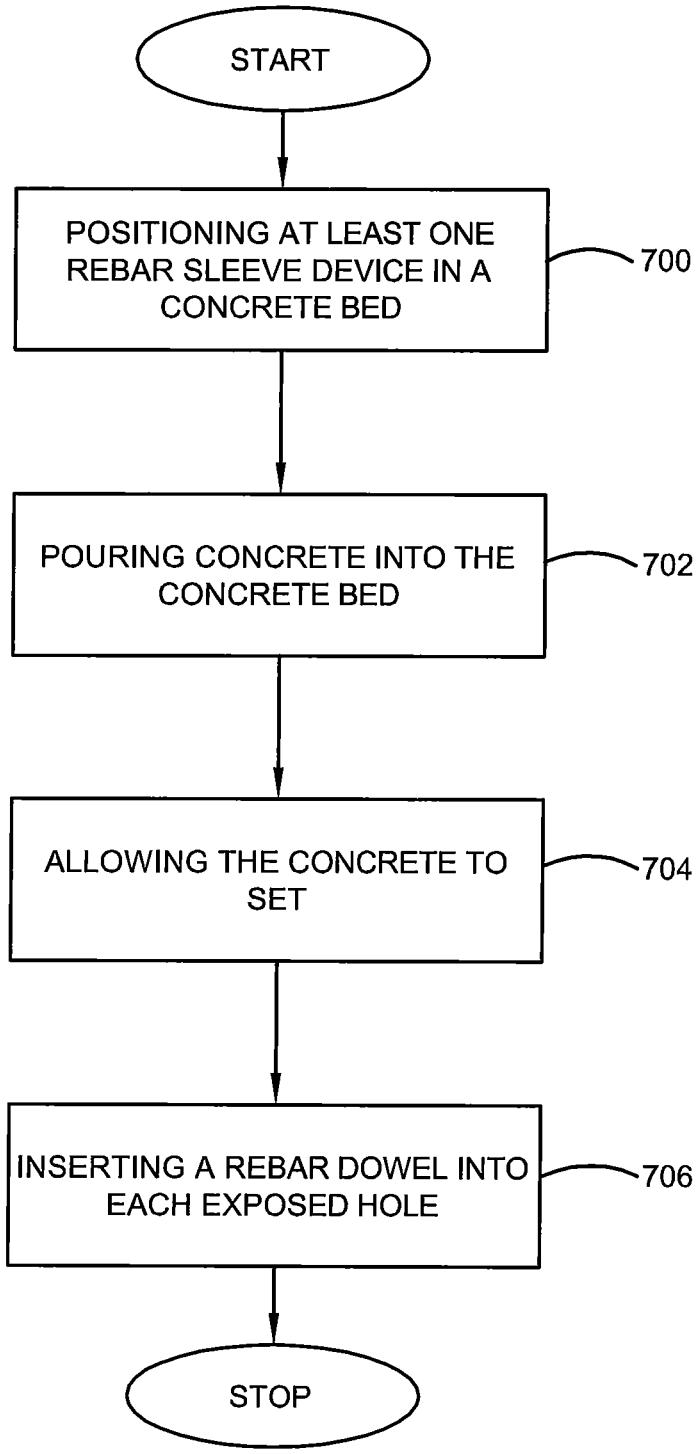
FIG. 7 illustrates a method of installing rebar dowels into freshly-applied concrete.
Figure 8:
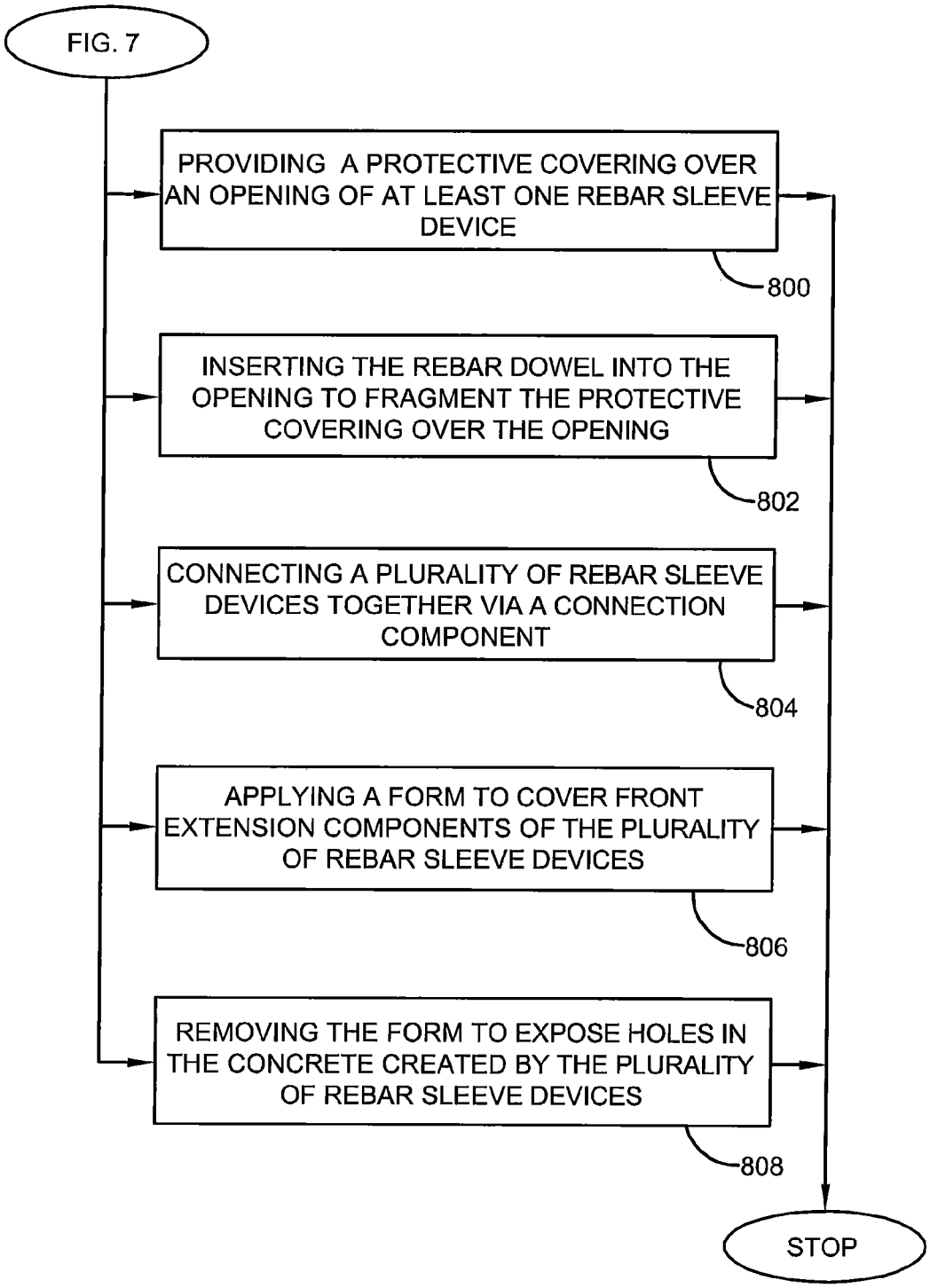
FIG. 8 illustrates further aspects in the installing method of FIG. 7.

FIGS. 7-8 illustrate methodologies of installing rebar dowels into concrete, according to various aspects of the innovation. While, for purposes of simplicity of explanation, the one or more methodologies shown herein (e.g., in the form of a flow chart or flow diagram) are shown and described as a series of acts, it is to be understood and appreciated that the subject innovation is not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation.

Referring to FIG. 7, a method of installing rebar dowels into concrete is illustrated. At 700, at least one rebar sleeve device is positioned in a concrete bed. The rebar sleeve device comprises a tubular unit with an opening at least one end thereof for receipt of a rebar dowel. The tubular unit is typically positioned horizontally and can be elevated by a back extension component and a front extension component secured to a base unit. The front extension component also comprises an opening through which the rebar dowel is inserted. The opening of the front extension component comprises a protective covering. The protective covering prevents concrete from filling in the opening, but allows for the insertion of a rebar dowel. Specifically, the protective covering is scored and bends inward to accommodate an inserted rebar dowel.

At 702, concrete is poured into the concrete bed. At 704, the concrete is allowed to set. Concrete forms around the rebar sleeve device creating a hole. And, at 706, rebar dowels are inserted into each exposed hole.

FIG. 8 illustrates further aspects in the installing method of FIG. 7. At 800, a protective covering is provided over an opening of the rebar sleeve device. Specifically, the front extension component of the rebar sleeve device comprises an opening through which the rebar dowel is inserted. The opening is typically a generally, circular hole, however, it can be any suitable shape to accept a rebar dowel. The opening of the front extension component comprises a protective covering. The protective covering prevents concrete from filling in the opening, but allows for the insertion of a rebar dowel. At 802, rebar dowels are inserted into the opening to fragment the protective covering over the opening. Specifically, the protective covering is scored and bends inward to accommodate an inserted rebar dowel. The protective covering is typically plastic but can be any suitable material for preventing concrete from filling in the opening, but also allowing the insertion of a rebar dowel.

And at 804, a plurality of rebar sleeve devices are connected together via a connection component. This allows for a series of evenly-spaced rebar sleeve devices to be installed before concrete is poured into the concrete bed. Typically, the plurality of rebar sleeve devices comprise eight rebar sleeve devices connected together via the connection component. At 806, a form is applied to cover the front extension components of the rebar sleeve devices. The form is typically metal or wood, and approximately ten feet in length. At 808, the form is removed to expose holes in the concrete created by the rebar sleeve devices.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A rebar sleeve device comprising:

a single tubular unit with an opening at least one end thereof for receipt of a rebar dowel;

a base unit configured for placement directly on the ground in a concrete bed, wherein the base unit supports the tubular unit; and a front extension component, comprising:

an opening having a protective covering configured over said opening;

a flange that extends up from a bottom of the front extension component to secure the rebar sleeve device with a concrete form;

wherein the tubular unit is elevated and positioned horizontally by the front extension component secured to the base unit, wherein the tubular unit is attached to the front extension component, aligned with the opening in the front extension component and extends from the front extension component in only one direction;

wherein the protective covering is scored and bends inward to accommodate insertion of said rebar dowel that would extend through the opening in said front extension component and into the tubular unit;

further wherein the protective covering prevents concrete from filling in the opening in said front extension during pouring of the concrete such that the rebar dowel can be inserted through said opening in said front extension after the concrete form has been removed from the flange; and wherein the rebar sleeve device is self-supporting whereby the tubular unit is supported by the front extension component secured to the base unit when the rebar sleeve device is placed in the concrete bed.

2. The rebar sleeve device of claim 1, further comprising a back extension component that connects the tubular unit to the base unit; wherein the tubular unit extends between the front extension component and the back extension component and does not extend beyond the front extension component or back extension component.

3. The rebar sleeve device of claim 1, further comprising a connection component that connects a plurality of rebar sleeve devices together.

4. The rebar sleeve device of claim 3, wherein the connection connects eight rebar sleeve devices together.

5. The rebar sleeve device of claim 1, wherein the flange is configured to support the form between the flange and the front extension component.

6. The rebar sleeve device of claim 1, wherein the tubular unit is comprised of polymer material, or metal.

7. The rebar sleeve device of claim 1, wherein the front extension component comprises a planar portion that extends up from the base unit and wherein said opening in said front extension component is configured in said planar portion.

8. The rebar sleeve device of claim 1, wherein the rebar sleeve device is a one piece unit.

9. A method of installing rebar into concrete, comprising the steps of:

providing at least one rebar sleeve device comprising:

a single tubular unit with an opening at least one end thereof for receipt of a rebar dowel;

a base unit configured for placement directly on the ground in a concrete bed, wherein the base unit supports the tubular unit; and a front extension component comprising:

an opening having a protective covering configured over aid opening; and a flange that extends up from a bottom of the front extension component to secure the rebar sleeve device with a concrete form;

wherein the tubular unit is elevated and positioned horizontally by the front extension component secured to the base unit, wherein the tubular unit is attached to the front extension component, aligned with the opening therein, and extends from the front extension component in only one direction; wherein the protective covering is scored and bends inward to accommodate an inserted rebar dowel that would extend through the opening in said front extension component and into the tubular unit, and wherein the rebar sleeve device is self-supporting secured to the base unit when the rebar sleeve device is placed in a concrete bed;

positioning at least one of said rebar sleeve devices in the concrete bed;

positioning a form between the flange and front extension component to cover the opening in the front extension component;

pouring concrete into the concrete bed;

allowing the concrete to set;

removing the form; and inserting a rebar dowel into the opening in the front extension component and into said single tubular unit supported by that front extension component.

10. The method of claim 9, wherein the step of positioning at least one of said rebar sleeve devices in a concrete bed further comprises connecting a plurality of rebar sleeve devices together via a connection component.

11. The method of claim 10, wherein the connection component allows for the plurality of said rebar sleeve devices to be evenly spaced apart.

12. The method of claim 11, wherein the plurality of said rebar sleeve devices comprise eight of said rebar sleeve devices connected together via the connection component.

13. A rebar sleeve system, comprising:

a plurality of rebar sleeve devices wherein each rebar sleeve device comprises:

a single tubular unit with an opening at least one end thereof for receipt of a rebar dowel;

a base unit configured for placement directly on the ground in a concrete bed, wherein the base unit supports the tubular unit; and a front extension component, comprising:

an opening having a protective covering configured over said opening;

a flange that extends up from a bottom of the front extension component to secure the rebar sleeve device with a concrete form; and a connection component that connects the plurality of rebar sleeve devices together;

each rebar sleeve device further comprises:

wherein the tubular unit is elevated and positioned horizontally by the front extension component secured to the base unit, wherein the tubular unit is attached to the front extension component, aligned with the opening in the front extension component and extends from the front extension component in only one direction;

wherein the protective covering is scored and bends inward to accommodate insertion of said rebar dowel that would extend through the opening in said front extension component and into the tubular unit;

further wherein the protective covering prevents concrete from filling in the opening in said front extension during pouring of the concrete such that the rebar dowel can be inserted through said opening in said front extension after the concrete form has been removed from the flange; and wherein the rebar sleeve device is self-supporting whereby the tubular unit is supported by the front extension component secured to the base unit when the rebar sleeve device is placed in the concrete bed.

14. The rebar sleeve system of claim 13, wherein the rebar sleeve devices further comprises a back extension component that connects the tubular unit to the base unit.

15. The rebar sleeve system of claim 14, wherein the flange is configured to support the concrete form between the flange and the front extension component.

16. The rebar sleeve system of claim 13, wherein the connection component connects at least eight of said rebar sleeve devices together.

* * * * *